US005192392A

United States Patent [19]

Peterson et al.

[11] Patent Number: 5,192,392

[45] Date of Patent: Mar. 9, 1993

[54] CONTAINER LABELER

[75] Inventors: Preston E. Peterson; Chester L. Peterson; Andrew J. Ryan, all of Napa, Calif.

[73] Assignee: The Bottling Room, Inc., Napa, Calif.

[21] Appl. No.: 662,063

[22] Filed: Feb. 28, 1991

[51] Int. Cl.[5] ..... B65C 9/00

[52] U.S. Cl. ..... 156/566; 156/564; 156/567; 156/570; 156/572; 156/578

[58] Field of Search ..... 156/566, 567, 570, 564, 156/DIG. 31, 573, 578, 568, 571, 572, 451

[56] References Cited

U.S. PATENT DOCUMENTS

| | | | |
|---|---|---|---|
| 2,240,106 | 4/1941 | Von Hofe | 156/DIG. 31 X |
| 2,525,741 | 10/1950 | Von Hofe et al. | 156/571 |
| 2,707,915 | 5/1955 | Nefzger | 156/572 X |
| 2,717,711 | 9/1955 | Banks | 156/571 |
| 3,440,116 | 4/1969 | Whitecar | 156/215 |
| 3,537,934 | 11/1970 | Münch | 156/571 |
| 4,203,798 | 5/1980 | Yamashita | 156/571 |
| 4,242,168 | 12/1980 | Carter | 156/571 |
| 4,265,695 | 5/1981 | Hurley et al. | 156/285 |
| 4,306,926 | 12/1981 | Pfulb | 156/215 |
| 4,361,460 | 11/1982 | Kronseder | 156/568 |
| 4,430,141 | 2/1984 | Zodrow | 156/360 |
| 4,457,801 | 7/1984 | Zodrow | 156/364 |
| 4,493,744 | 1/1985 | Voltmer et al. | 156/568 |
| 4,521,271 | 6/1985 | Voltmer et al. | 156/568 |
| 4,594,123 | 6/1986 | Eder | 156/456 |
| 4,620,891 | 11/1986 | Applegate et al. | 156/DIG. 31 X |
| 5,078,826 | 1/1992 | Rogall | 156/451 |

FOREIGN PATENT DOCUMENTS

| | | | |
|---|---|---|---|
| 2623818 | 12/1977 | Fed. Rep. of Germany | 156/567 |

OTHER PUBLICATIONS

Article by New Jersey Machine Inc., in existence as of filing date.

Brochure by MAG Etikettiermaschinen, in existence as of filing date.

Brochure by Cavagnino & Gatti, in existence as of filing date.

Brochure by Krones entitled "Krones Vinetta" in existence as of filing date.

Brochure by Cavagnino & Gatti, Series CG72N, in existence as of filing date.

*Primary Examiner*—David A. Simmons
*Assistant Examiner*—James J. Engel, Jr.
*Attorney, Agent, or Firm*—Townsend and Townsend

[57] ABSTRACT

The container labeler (2) includes broadly a container conveyor (8) and one or more label applying assemblies (4,6). The label applying assembly includes a label supply hopper (10) which stores a stack of labels (16), a transfer assembly (24) which removes labels one-at-a-time from the label supply hopper, a drive assembly (50) which drives the label from the transfer assembly to an adhesive application assembly (62), and a label pressing member (76) which presses against a container (12) on the container conveyor (78) to form a nip (74). The adhesive application assembly applies adhesive to the back of the label and delivers the label to the nip. The container conveyor includes rotating pedestals (96) upon which the containers rest so that the label from the adhesive applying assembly is applied to the container by the movement of the label into the nip and the rotation of the container.

9 Claims, 5 Drawing Sheets

CONTAINER LABELER

BACKGROUND OF THE INVENTION

A wide variety of machines have been developed for automatically labeling bottles and other cylindrical containers. With one such machine, the label has an adhesive applied to the back of the label, typically using an adhesive—applying glue roller. The prepared label is transferred to a transfer roller with the front edge of the label secured to the transfer roller. The transfer roller translates and presses the label against a stationary container. This causes the label, due to the adhesive on the back of the label, to stick to the container after released by the transfer roller. The container is then moved down the line and the label is smoothed onto the container by brushes.

One of the problems with transfer roller-type labelling machines is they are not flexible. That is, if one wishes to use the labelling machine with a different size or type of label, various parts on the machine must be changed since they are especially adapted for one label type and size, or at best a narrow range of label types and sizes. Although this drawback may not be a problem for a labelling station in which the labels and containers do not vary, it creates significant drawbacks when flexibility is needed. This is particularly true in certain industries, such as the wine industry, in which certain services are provided to small customers by outside contractors. For example, mobile bottling lines are used to bottle wine for small wineries, which cannot justify the expense of purchasing their own bottling line for a relatively limited production. However, such mobile bottling lines must be able to accommodate different sizes, types and shapes of labels. Changing labels with transfer roller-type labeling machines requires the bottling line be shut down, components replaced and the machine readjusted, assuming the parts are available, all of which adds to the expense of the final product.

SUMMARY OF THE INVENTION

The present invention is directed to a container labeler which requires no transfer roller thus permitting maximum flexibility as to the type, shape and size of labels applied.

The container labeler includes broadly a container conveyor and at least one label applying assembly. The label applying assembly includes a label supply hopper which stores a stack of labels, a transfer assembly which removes labels one-at-a-time from the label supply hopper, a drive assembly which drives the label from the transfer assembly to an adhesive application assembly, and a label pressing member which presses against a container on the container conveyor to form a nip. The adhesive application assembly applies adhesive to the back of the label and delivers the label to the nip.

The container conveyor includes rotating pedestals upon which the containers rest. The label from the adhesive applying assembly is applied to the container by the movement of the label into the nip and the rotation of the container as the container moves along the line.

In a preferred embodiment, the label supply hopper stores a stack of labels. One end of the stack of labels is accessible by a label transfer assembly at a label pick-off point. The labels are removed one-at-a-time from the label pick-off point, preferably using a vacuum transfer head. The transfer head then moves the label to the drive assembly. The drive assembly typically includes a drive roller and an idler roller. The drive roller drives the label, which has been released by the vacuum transfer head, to the adhesive applying assembly.

The adhesive applying assembly typically includes a grooved adhesive roller having a thin film of adhesive applied to its outer surface and against which the back of the label is driven by the drive assembly. The adhesive applying assembly also includes a number of picker fingers which ride in grooves along the length of the adhesive roller, remove the label, now having adhesive applied to its back, and direct the label to a label applying position, formed at the nip between a bottle and the label pressing member, along the conveyer line.

The conveyor line preferably includes a rotary conveyor line segment at the label applying position. Thus, the containers move along a circular arc along the conveyer line segment while rotating around their own axes. The surface speed of the container and the speed of movement of the label at the label applying position are preferably equal. The rotating container picks up the label at the label applying position. The initial driving force for this is provided by the adherence of the label to the adhesive roller. After the end of the label has separated from the adhesive roller, the portion of the label already adhered to the surface of the rotating container pulls the rest of the label through the nip and onto its surface. This is aided by the momentum of the label itself. The label pressing member, preferably in the form of a spring-loaded sponge roller, is used at the label applying position to press the label against the roller for proper adherence.

A primary advantage of the invention is that it permits the label applying assembly to be used with different sizes, types and shapes of labels over a wide range without requiring any change of parts, merely adjustments. This is because the label is applied directly from the adhesive roller to the bottle without the need for a transfer roller.

Other features and advantages of the invention will appear from the following description in which the preferred embodiment has been set forth in detail in conjunction with the accompanying drawings.

DESCRIPTION OF THE PREFERRED EMBODIMENT

Figure 1:
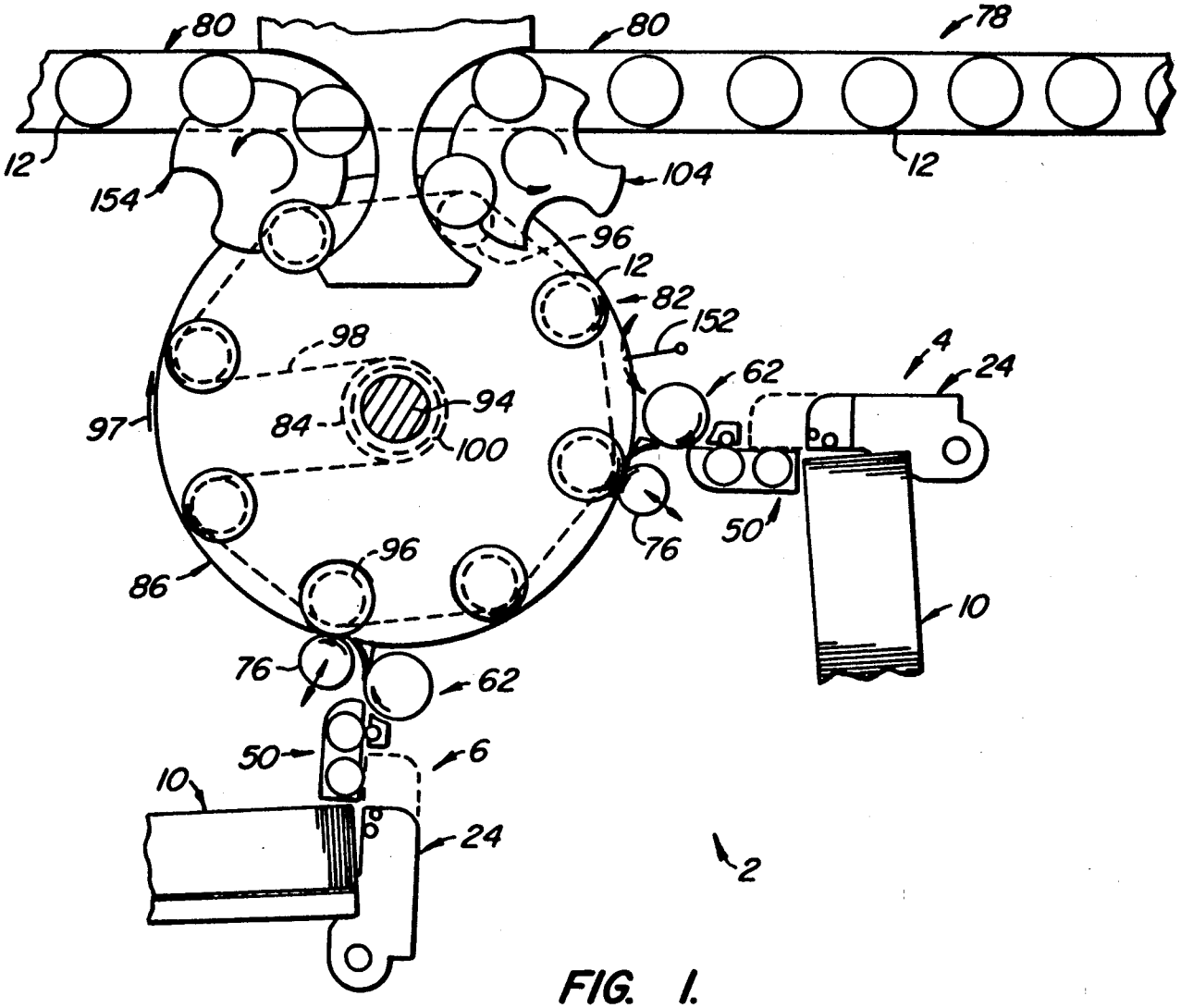
FIG. 1 is an overall schematic view of a bottle labeler made according to the invention.

FIG. 1 illustrates bottle labeler 2 as including broadly first and second label applying assemblies 4, 6 and a bottle conveyor 80. Assemblies 4, 6 and conveyer 8 are driven by a drive assembly 9, described below with reference to FIG. 5. Assemblies 4, 6 are identical so that only assembly 4 will be described.

Figure 2:
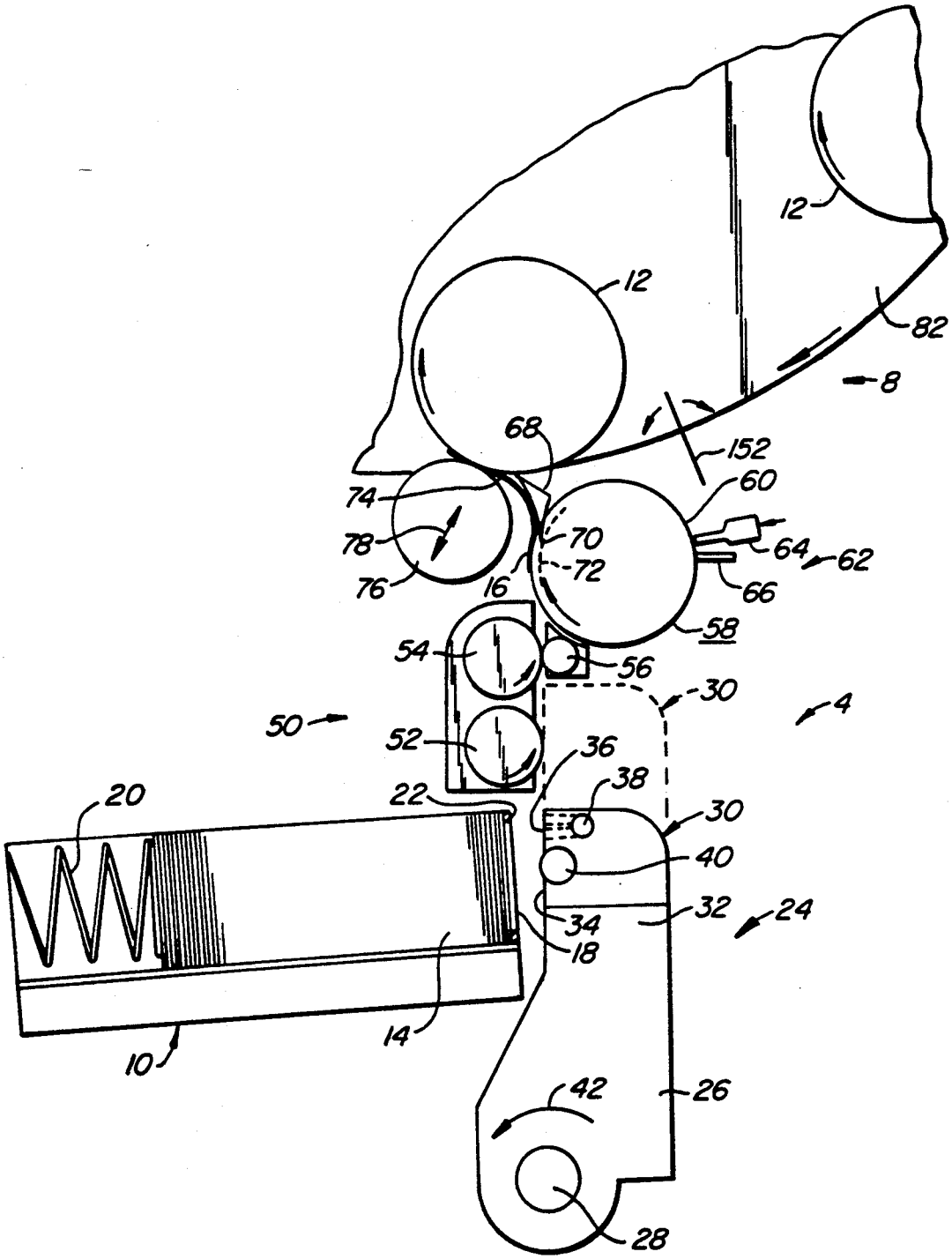
FIG. 2 is an enlarged view of the label applying assembly of FIG. 1 showing a label being applied to a bottle and the transfer head in its initial position.

Label applying assembly 4, shown best in FIG. 2, includes a common platform, not shown, by which the entire label applying assembly 4 can be adjusted in height according to the height of bottle conveyor 80 and the height and size of bottles 12 carried by the bottle conveyor. Assembly 4 includes a generally conventional label supply hopper 10 which holds a stack 14 of labels 16. Stack 14 of labels 16 are provided to a label pick-off point 18 through the use of a spring 20. Small protrusions 22 prevent the stack 14 of labels 16 from being pushed out of hopper 10 through pick-off point 18. Hopper 10 may be similar to that shown in U.S. Pat. No. 4,521,271 and sold as part of the MUSTANG brand bottle labelling machine sold by New Jersey Machine, Inc., of Fairfield, N.J.

Figure 3A:
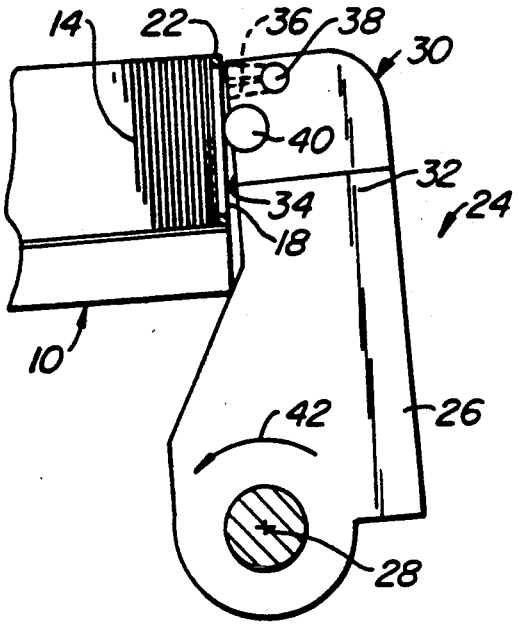
FIG. 3A shows the transfer head of FIG. 2 in its label select position.
Figure 3B:
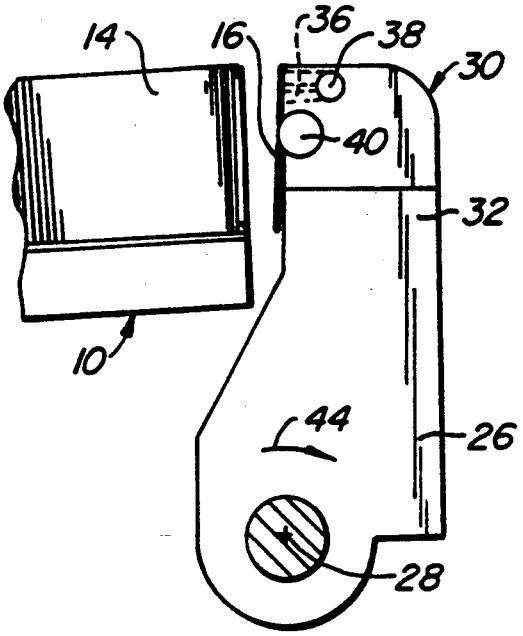
FIG. 3B shows the transfer head of FIG. 2 in its label retrieve position.
Figure 4:
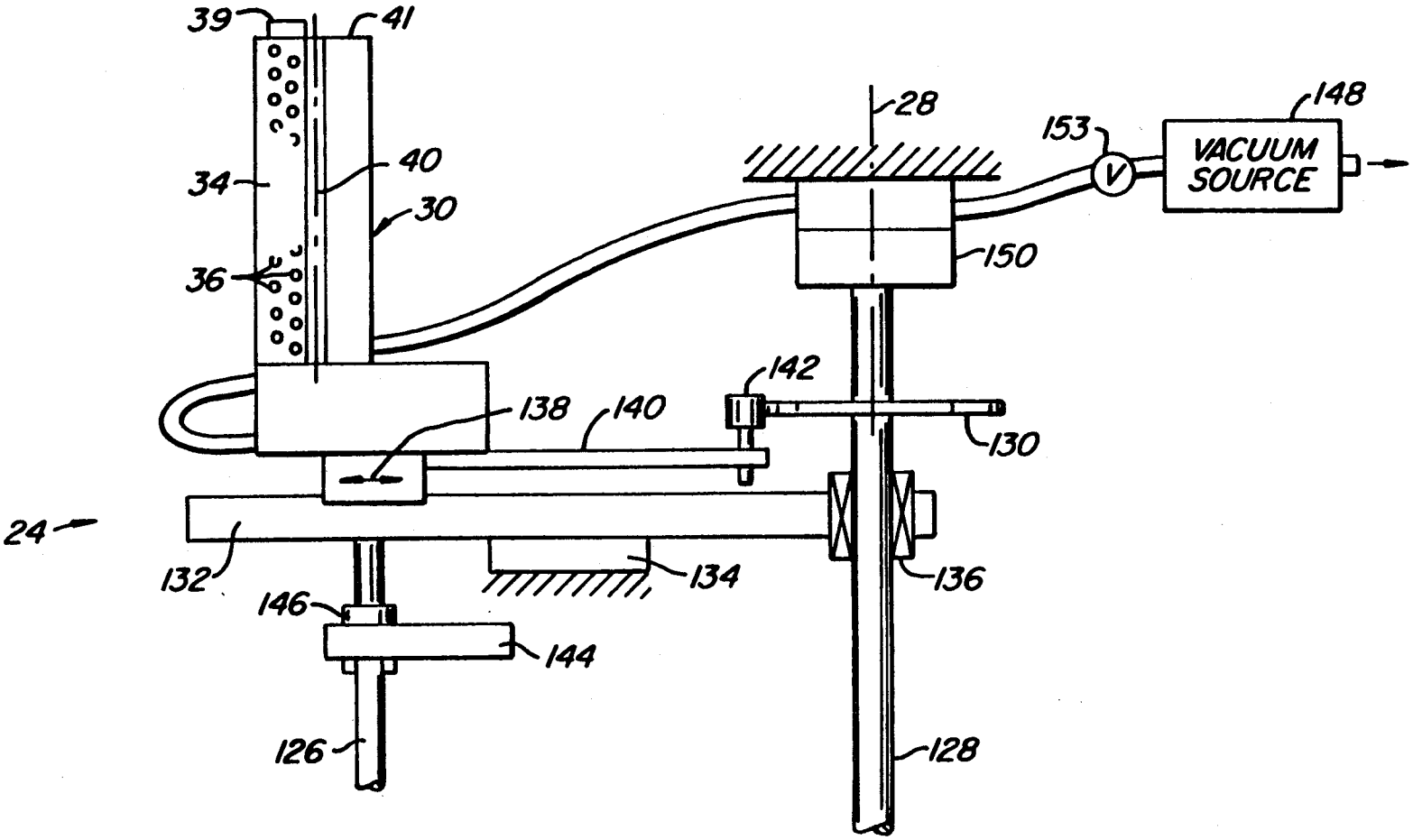
FIG. 4 is a schematic front view of the transfer head of FIG. 2.

Assembly 4 also includes a transfer assembly 24, having a pivotal transfer arm 26 which pivots about a pivot 28 mounted to the common platform, and a transfer head 30 mounted to the outer end 32 of arm 26. Transfer head 30 includes a face 34 having numerous vacuum openings 36, shown in FIG. 4, coupled to a common vacuum plenum 38 and used to remove labels 16 one-at-a-time from pick-off point 18 of hopper 10. Various length plugs are mounted to the top 41 of head 30 and extend into manifold 38 to seal off a chosen number of holes 36 adjacent top 41 according to the height of label 16. Transfer head 30 also includes an idler roller 40 against which label 16 rests, as is shown in FIGS. 3A, 3B and 4, once removed from stack 14.

Figure 3C:
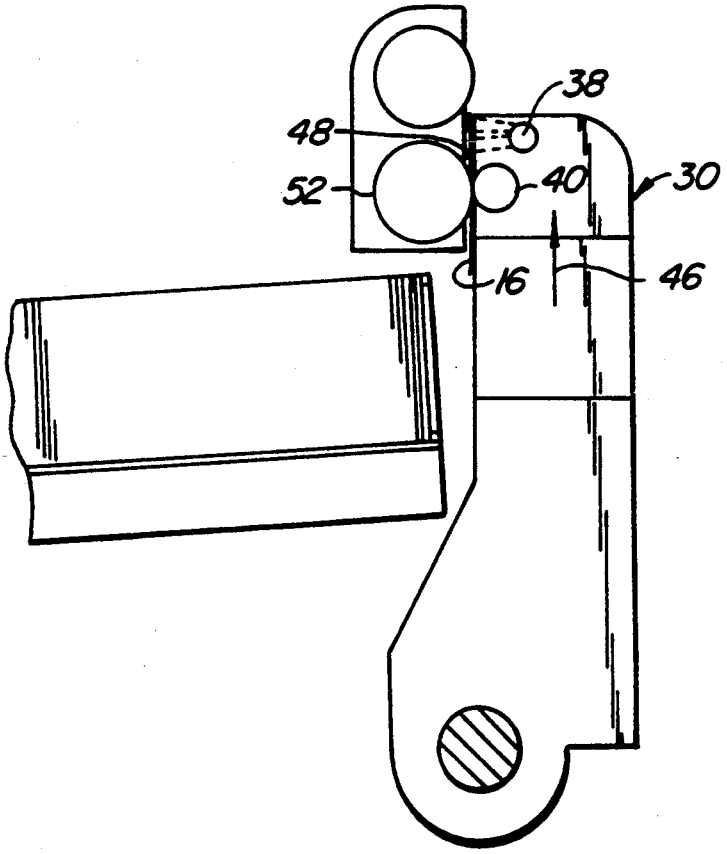
FIG. 3C shows the transfer head of FIG. 2 in its label release position.

Movement of transfer assembly 24 occurs generally as follows. From the position of FIG. 1, arm 26 pivots in the direction of arrow 42 so that face 34 of head 30 is at pick-off point 18. This is shown in FIG. 3A. At this point, a partial vacuum is applied to plenum 38 and thus at vacuum openings 36 so that the outermost label 16 becomes secured to transfer head 30. Transfer assembly 24 then pivots away from pick-off point 18 as indicated by arrow 44 in FIG. 3B with a label 16 secured to face 34. Transfer head 30 then moves in a straight line as indicated by arrow 46 in FIG. 3C. This places label 16 at a drive position 48 relative to a drive assembly 50. The mechanical drive components which accomplish these movements are described below in conjunction with FIGS. 4 and 5.

Drive assembly 50 includes first and second drive rollers 52, 54. Drive roller 52 contacts idler roller 40 and pinches label 16 therebetween. Just before transfer head 30 arrives at the position of FIG. 3C, the partial vacuum within plenum 38 is shut off, thus releasing label 16. This permits drive roller 52 to drive label 16 from between rollers 52, 40 to between drive roller 54 and an additional idler roller 56.

Label 16 is driven by roller 54 to engage the grooved surface 58 of an adhesive roller 60 of an adhesive application assembly 62. Assembly 62 also includes a pump-type adhesive applicator 64 and a scraper 66 which together apply a thin layer of an adhesive to surface 58. Assembly 62 also includes a set of picker fingers 68 having ends 70 which fall within the grooves 72 formed in surface 58. Picker fingers 68 guide label 16 from surface 58 towards a nip 74 formed between a bottle 12 and a spring biased application roller 76. Roller 76 is made of a spongy material and is spring biased against the outer surface of bottle 12 for movement along the conveyor line. Thus, label 16 is directed right at a label applying position at nip 74 by assembly 62.

Figure 5:
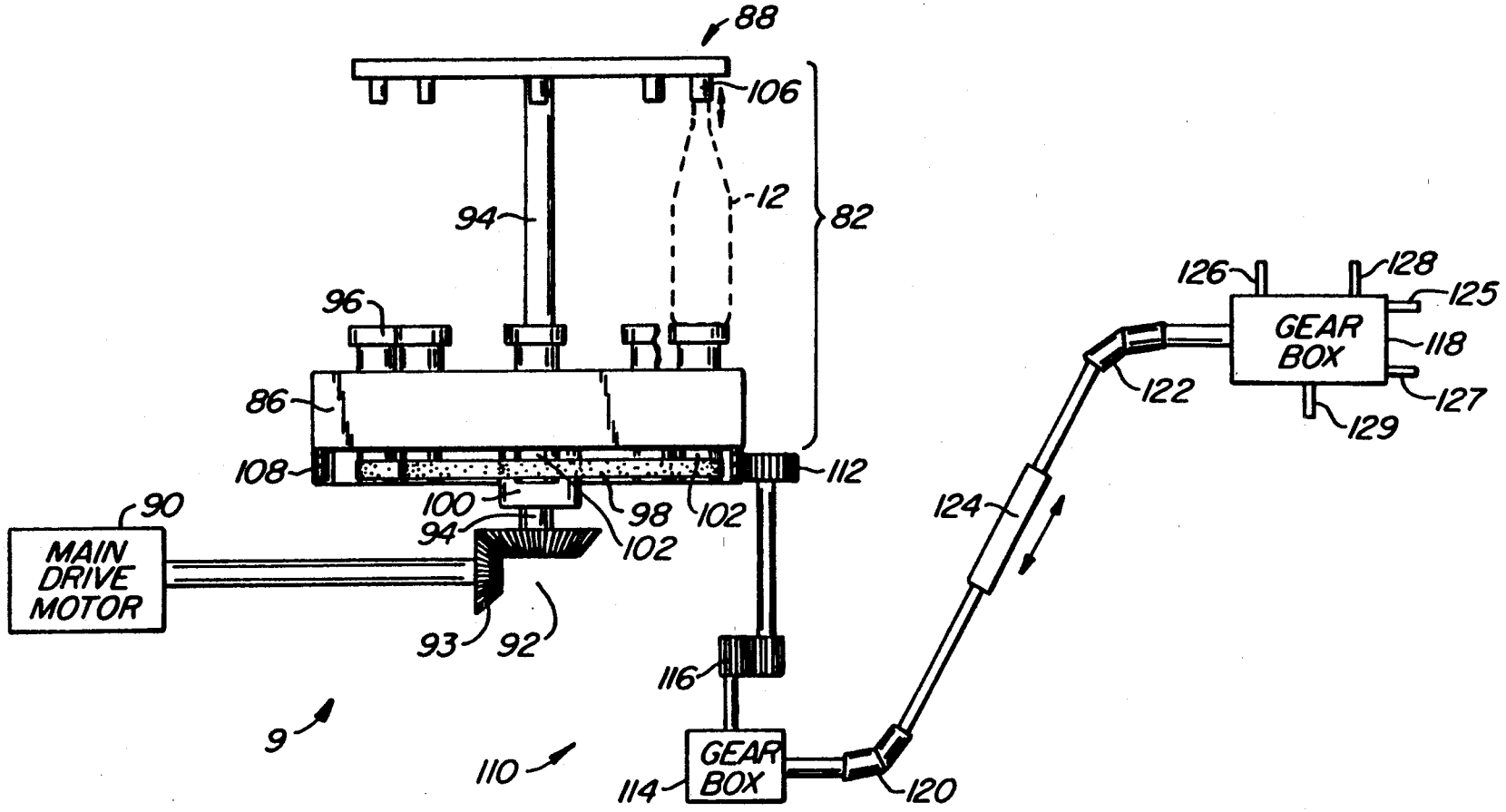
FIG. 5 is a schematic view of the drive assembly of the bottle labeler of FIG. 1.

Referring the reader now to FIGS. 1, 4 and 5, bottle conveyor 8 includes a conveyor line 78 including a straight conveyor line segment 80 and a rotary conveyor line segment line 82. Drive assembly 9 is seen to include main drive motor 90 which drives bevel gear arrangement 92, through a bevel gear 93 and a main drive shaft 94, thus rotating rotary platform 86. Rotary segment 82 includes a rotary platform 86 and a rotary bottle top support 88 driven in unison by main drive motor 90 through beveled gear arrangement 92 connected to main drive shaft 94. Straight conveyor line segment 80 is also driven through bevel gear 93 coupled to a drive sprocket (not shown) at one end of segment 80.

Rotary platform 86 includes eight pedestals 96 which rotate in the direction of arrow 97 as rotary platform 86 rotates. Pedestals 96 also rotate about their own axes through the use of a belt 98 and a stationary pulley 100. Belt 98 engages separate pulleys 102 fixed to the undersides of pedestals 96. As rotary platform 86 rotates in the direction of arrow 97, belt 98 "walks around" stationary pulley 100, causing pulleys 102 and pedestals 96 to rotate about their own axes. Pulleys 100, 102 are sized so that for each complete revolution of rotary platform 86, each pedestal 96 makes two complete revolutions. Thus, a quarter turn of rotary platform 86 will cause a bottle 12 supported by a pedestal 96 to rotate about its axis one half turn. Although a chain drive or cogged belts could be used instead of flat belt 98, this is not considered necessary. Also, pedestals 96 could be rotated about their own axes through the use of pinion gears which engage a stationary internal ring gear. This, however, is not preferred because of the additional expense and lack of flexibility.

Bottles 12 are placed onto pedestals 96 by a rotary positioner 104. Rotary platform 86 also includes a ring gear 108 which rotates with platform 86. Positioner 104 is coupled to ring gear 108 so to drive positioner 104 at a speed appropriate to the rotational speed of rotary platform 86. Once a bottle 12 is properly positioned on pedestal 96, a generally conventional bottle top positioner 106, such as one made by Krones AG of Neutraubling, Germany, moves downwardly onto the top of bottle 12 to stabilize the bottle. Positioner 106 can pivot freely about its own vertical axis so that while it keeps bottle 12 from being pushed off of pedestal 96, pedestal 106 does not hinder the rotation of the bottle. Rotary bottle top support 88 includes eight such bottle top positioners 106 to accommodate each of the eight pedestals 96 carried by rotary platform 86.

Rotary platform 86 includes a ring gear 108 to which a pair of drive trains 110, one for each assembly 4, 6, are coupled. Only one drive train 110 is shown in FIG. 5 for the sake of simplicity.

Drive train 110 includes a pinion 112 coupled to a planetary gear box 114 through a pair of spur gears 116. Planetary gear box 114 is of generally conventional design and has an adjustable outer ring to allow timing between the operation of label applying assembly 4 and the movement of rotary platform 86. Gear box 114 is coupled to a gear box 118 through a pair of constant velocity U-joints 120, 122 and a splined coupling 124. This permits label applying assembly 4 to be positioned relative to rotary platform 86 at different positions around the periphery of rotary platform 86.

Gear box 118 has a first drive shaft 126 used to control the pivoting of arm 26 and a second drive shaft 128 used to control the reciprocation of transfer head 30. Note that drive shaft 128 acts as pivot 28 shown in FIG. 2. Gear box 118 also has outputs 125, 127, 129 coupled to drive rollers 52, 54 and adhesive roller 60 respectively.

Drive shaft 128 carries a reciprocating drive cam 130 which rotates together with drive shaft 128. A track 132 is supported by a skid plate 134. Track 132 is mounted to drive shaft 128 through bearing 136 so that skid plate 134 can pivot about drive shaft 128, and thus about pivot 28, to provide the pivotal movement shown in FIGS. 3A and 3B. Head 30 is mounted to track 132 for movement in the direction of arrow 138, which corresponds to arrow 46 in FIG. 3C. Head 30 is connected to reciprocating drive cam 130 through a link 140 and a reciprocating follower 142 mounted to the end of link 140. A spring biasing mechanism, not shown, normally biases transfer head 30 towards drive shaft 128 so to keep follower 142 engaged with cam 130.

First drive shaft 126 has a pivot drive cam 144 mounted to its upper end. Track 132 is coupled to cam 144 through a pivot drive follower 146 which engages the camming surface of cam 144. Track 132 is biased so to keep follower 146 engaged with cam 144.

Since it is desired to turn the vacuum on and off during each cycle of transfer assembly 24, a vacuum source 148 is coupled to transfer head 30 through a rotary vacuum timer 150, shown schematically in FIG. 4.

Label applying assembly 4 also includes a pivotable switch arm 152, coupled to rotary vacuum timer 150, which senses when a bottle 12 passes the switch arm. If for some reason no bottle 12 is present on a pedestal 96, switch arm 152, coupled to an electrically controlled valve 153 positioned between vacuum source 148 and timer 150, is not deflected. This causes valve 153 to decouple source 148 from rotary vacuum timer 150 to return plenum 38 to atmospheric pressure during the next cycle of transfer head 30.

In use, bottles 12 move along straight line segment 80 and are picked up one-at-a-time by rotary positioner 104. Rotary positioner 104 rotates in conjunction with the movement of rotary conveyor line segment 82 so to properly position bottle 12 onto the next available rotating pedestal 96. As bottle 12 moves towards label applying assembly 4, the bottle is rotated constantly by pedestal 96. As bottle 12 passes switch arm 152, the bottle activates the switch arm signalling the approach of another bottle 12. This permits the normal functioning of rotary vacuum timer 150. When bottle 12 gets to the position of FIG. 1, application roller 76, which is lightly biased towards line segment 80, is pushed away from the line segment to create nip 74.

Simultaneously with the above, labels 16 are provided to adhesive roller 60 from pick-off point 18 of label supply hopper 10. Labels are removed one-at-a-time from pick-off point 18 by the rotary movement of arm 26 in the direction of arrow 42 of FIG. 3A, the reverse rotary movement of arm 26 in the direction of arrow 44 of FIG. 3B, label 16 having been secured to head 30 through the use of suction applied at vacuum openings 36. Transfer head 30 moves in the direction of arrow 46 and releases label 16 to drive assembly 50. Drive assembly 50 then drives label 16 against surface 58 of adhesive roller 60. Label 16 is then picked off from rotating surface 58 of adhesive roller 60 by picker fingers 68 and is driven into nip 74. The rotating bottle 12 at nip 74 causes label 16, the leading edge of which has now adhered to the bottle, to be applied to the rotating surface of the bottle. Good label adherence is achieved through the use of the pressure caused by application roller 76. A back label, if needed, can be applied at label applying assembly 6 downstream of assembly 4. The labelled bottle continues around the periphery of rotary conveyor line segment 82 until the labeled bottle is engaged by a second rotary positioner 154 which removes bottle 12 from segment 82 and onto conveyor line segment 84 for continued processing down the line.

Modifications and variations can be made to the disclosed embodiment without departing from the subject of the invention as defined in the following claims. For example, although the invention has been described with reference to labeling bottles, other types of containers, both circular and non-circular, could be labeled as well.

What is claimed is:

1. A container labeler comprising:

a label supply hopper for storing a supply of labels and presenting a label at a label pick-off point;

a label drive assembly;

a transfer assembly including a transfer head, which transfers the label from the pick-off point to the label drive assembly, and an idler roller mounted to the transfer head;

an adhesive applying assembly;

the drive assembly driving the label from the transfer assembly to the adhesive applying assembly;

a conveyor line having a straight conveyor portion and a rotary conveyor portion thereof;

the adhesive applying assembly applying adhesive to a back side of the label and transferring the label at a chosen speed to a label applying position along the conveyor line;

the rotary conveyor portion of the conveyor line having continuously rotating pedestals configured to support and rotate the containers about the containers' own axes as the containers move along the said rotary conveyor portion line, the pedestals rotating at a speed so that the surface speed of a container supported buy the pedestal at the label applying position is generally equal to the chosen speed of movement of the label at the label applying position; and a label pressing roller at the label applying position biased to press the label against the rotating container.

2. The container labeler of claim 1 wherein the transfer head includes a vacuum pick-up which secures the label to the transfer head from the pick-off point to the drive assembly at which point the vacuum pick-up releases the label to the drive assembly.

3. The container labeler of claim 1 wherein the transfer head moves along an arcuate path from a label select position adjacent the pick-off point to an intermediate position spaced apart from the pick-off point, and along a straight path from the intermediate position to a label release position adjacent the drive assembly.

4. The container labeler of claim 1 wherein the drive assembly includes a stationary drive roller and an opposed idler roller.

5. The container labeler of claim 4 wherein the drive assembly further includes a second, stationary drive roller.

6. The container labeler of claim 1 wherein the adhesive applying assembly includes an adhesive roller having a surface speed generally equal to the chosen speed and a label picker for removing labels from the adhesive roller and directing the labels towards the label applying position.

7. The container labeler of claim 1 wherein the label pressing roller is spring biased to press against containers.

8. The container labeler of claim 1 wherein each pedestal includes a circular drive element, the container labeler further comprising an endless loop flexible drive member coupling each of the circular drive elements of the pedestals and to a fixed position circular drive element.

9. The container labeler of claim 1 wherein the rotary conveyor line segment includes a rotary container top support having rotatable elements positioned over the rotating pedestals to engage and stabilize the containers on said pedestals.

* * * * *